US007210906B2

(12) United States Patent
Papple

(10) Patent No.: US 7,210,906 B2
(45) Date of Patent: May 1, 2007

(54) INTERNALLY COOLED GAS TURBINE AIRFOIL AND METHOD

(75) Inventor: Michael Leslie Clyde Papple, Ile des Soeurs (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 10 days.

(21) Appl. No.: 10/914,185

(22) Filed: Aug. 10, 2004

(65) Prior Publication Data

US 2006/0034690 A1 Feb. 16, 2006

(51) Int. Cl.
*F01D 5/18* (2006.01)

(52) U.S. Cl. ..... 416/1; 416/97 R

(58) Field of Classification Search ..... 416/1, 416/97 R; 415/115; 29/889.721
See application file for complete search history.

(56) References Cited

U.S. PATENT DOCUMENTS

| | | | | |
|---|---|---|---|---|
| 3,017,159 | A * | 1/1962 | Foster et al. | 416/90 R |
| 3,807,892 | A | 4/1974 | Frei et al. | |
| 3,885,609 | A | 5/1975 | Frei et al. | |
| 3,989,412 | A | 11/1976 | Mukherjee | |
| 4,019,831 | A | 4/1977 | Franklin et al. | |
| 4,616,976 | A | 10/1986 | Lings et al. | |
| 4,767,261 | A | 8/1988 | Godfrey et al. | |
| 5,052,889 | A | 10/1991 | Abdel-Messeh | |
| 5,462,405 | A * | 10/1995 | Hoff et al. | 416/97 R |
| 5,464,322 | A | 11/1995 | Cunha et al. | |
| 5,599,166 | A | 2/1997 | Deptowicz et al. | |
| 5,601,399 | A | 2/1997 | Okpara et al. | |
| 5,772,397 | A | 6/1998 | Morris et al. | |
| 5,857,837 | A * | 1/1999 | Zelesky et al. | 416/97 R |
| 5,975,851 | A | 11/1999 | Liang | |
| 6,234,753 | B1 * | 5/2001 | Lee | 416/97 R |
| 6,406,260 | B1 | 6/2002 | Trindade et al. | |
| 6,631,561 | B1 | 10/2003 | Anding et al. | |
| 6,835,046 | B2 * | 12/2004 | Strassberger et al. | 416/97 R |
| 2003/0133795 | A1 * | 7/2003 | Manning et al. | 416/97 R |

FOREIGN PATENT DOCUMENTS

| | | |
|---|---|---|
| WO | WO01/98634 | * 12/2001 |

* cited by examiner

*Primary Examiner*—Edward K. Look
*Assistant Examiner*—Nathan Wiehe
(74) *Attorney, Agent, or Firm*—Ogilvy Renault LLP

(57) ABSTRACT

An internally cooled airfoil for a gas turbine engine and a method of cooling in which at least two substantially parallel passages are in fluid communication with an exit plenum and adapted to reduce stagnation and improve strength, particularly in wide chord blades.

17 Claims, 5 Drawing Sheets

INTERNALLY COOLED GAS TURBINE AIRFOIL AND METHOD

TECHNICAL FIELD

The invention relates to internally cooled airfoil structures within a gas turbine engine.

BACKGROUND

The design of gas turbine airfoils is the subject of continuous improvement, since design directly impacts cooling efficiency. In some gas turbine designs, the turbine airfoil chord is long relative to the airfoil length, resulting in a "short" & "fat" airfoil. Traditional serpentine cooling passages need either to have increased number of turns to account for the additional area to cool, which results in increased pressure losses, or the individual passages must simply be wider, which leads to "dead" zones in which air tends to stagnate undesirably, thereby reducing cooling efficiency. Therefore, there continues to be a need for improved cooling for internally cooled gas turbine airfoils.

SUMMARY

In one aspect the invention provides an internally cooled airfoil for a gas turbine engine, the airfoil having a hollow section and a trailing edge, the airfoil comprising:

a plurality of partition walls located in the hollow section and defining internal cooling air passages, at least some of the passages extending from an inlet to at least one outlet adjacent to the trailing edge; and at least one crossover located in the hollow section and being adjacent to the outlet, the crossover generally extending radially in the hollow section and having a distal end portion on an end of the airfoil distally opposite the inlets of the passages, the crossover being in fluid communication with at least two of said passages that are substantially parallel to each other, one of which said parallel passages being dedicated to supplying cooling air to the distal end portion of the crossover.

In another aspect the invention provides an internally cooled gas turbine airfoil comprising:

a hollow airfoil body having a first end, a second end and a trailing edge extending therebetween; and a plurality internal passages defined in the hollow airfoil body, the passages including at least two passages extending from distinct inlets in the first end and in parallel communication with an exit plenum defined in the hollow airfoil body adjacent to the trailing edge, wherein the passages are disposed side-by-side and wherein a first one of said at least two passages communicates directly with a substantially larger portion of the exit plenum than a second.

In a further aspect the invention provides an airfoil for use in a gas turbine engine, the airfoil comprising a hollow section with passages adapted to direct an internally-circulating flow of cooling air, the airfoil including a trailing edge and at least one exit plenum adjacent to the trailing edge, the hollow section including partition walls dividing adjacent passages, the adjacent passages including at least two fluidly parallel cooling air paths upstream of and communicating in parallel with the exit plenum.

In a still further aspect the invention provides a method of cooling an airfoil of a gas turbine engine using an internally-circulating flow of cooling air, the airfoil including a trailing edge and at least one exit plenum adjacent to the trailing edge, the method comprising:

dividing the flow of cooling air in at least two fluidly parallel cooling air paths; and then directing the cooling air paths parallelly through the exit plenum.

Still other aspects and inventions will be apparent in the appended description and figures.

DETAILED DESCRIPTION

Figure 1:
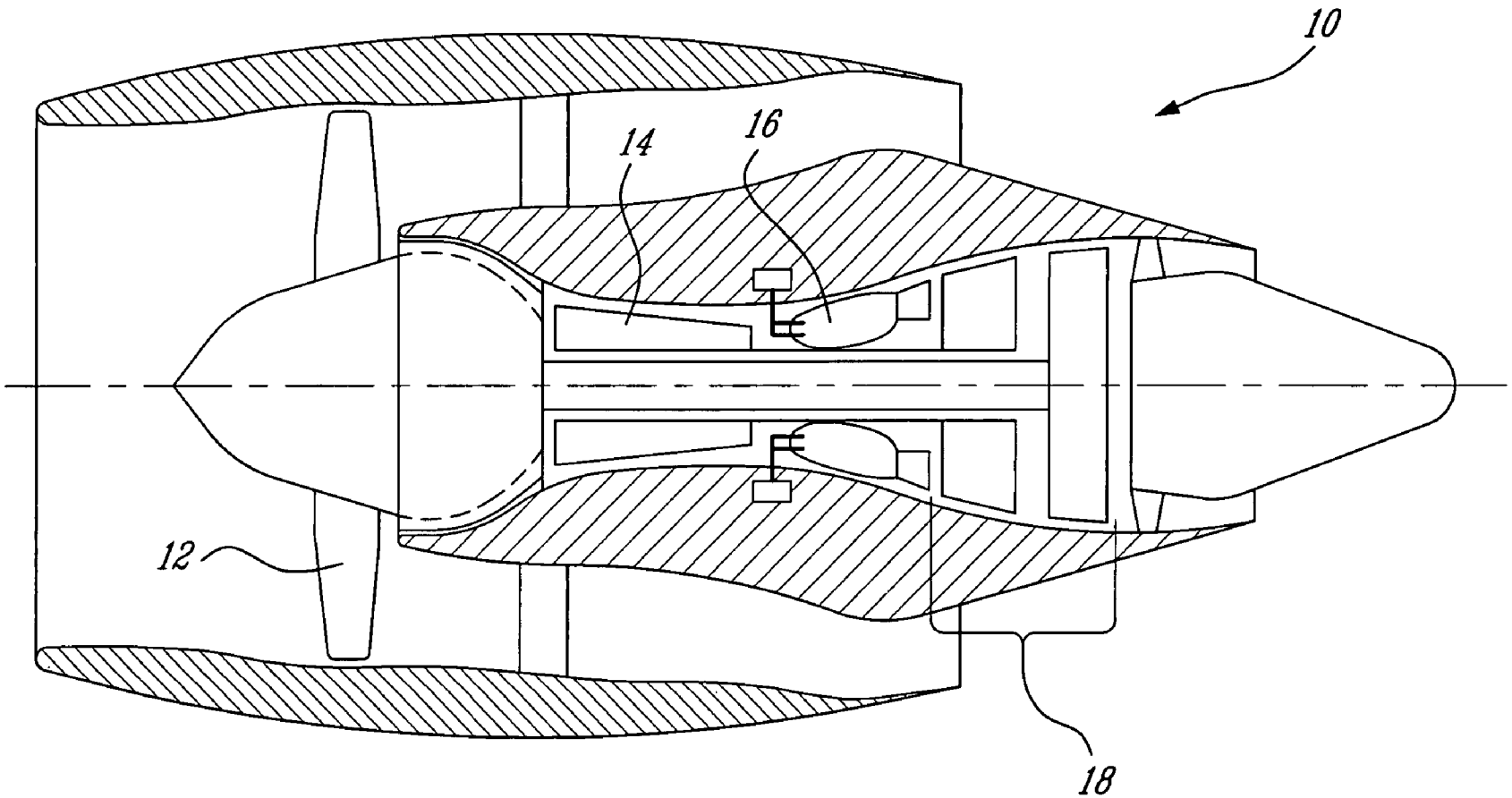
FIG. 1 shows a generic gas turbine engine to illustrate an example of a general environment in which the invention can be used.

FIG. 1 illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
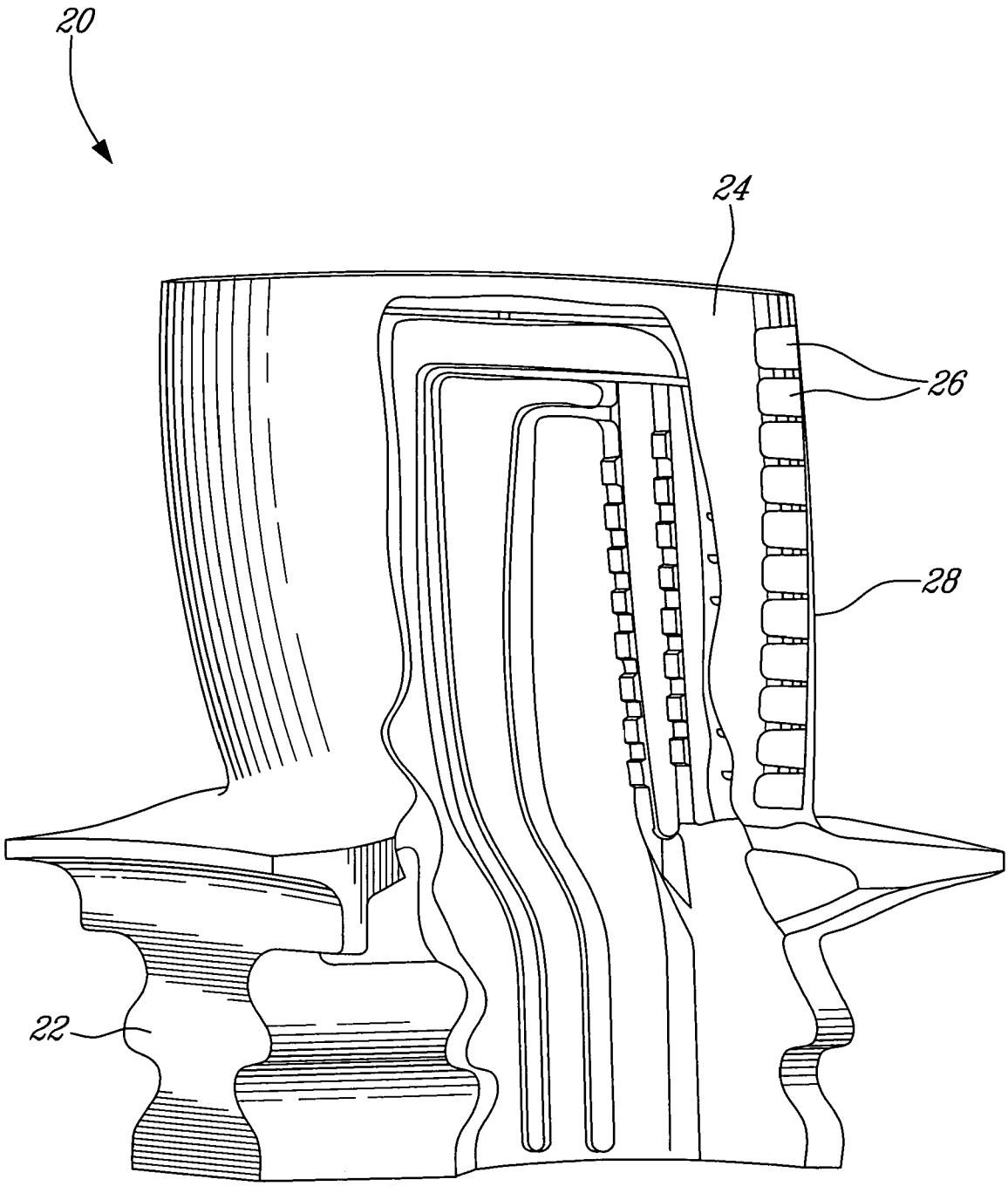
FIG. 2 is an isometric view of a turbine blade according to the invention, a portion of the blade being cut away to show some of the internal cooling passages in the airfoil thereof.

FIG. 2 shows a turbine blade having an airfoil 20 according to one embodiment of the invention. Although a turbine blade is shown in FIG. 2, the present invention can be used in a compressor and turbine blades and vanes. The airfoil 20 extends from a root section 22 and comprises a hollow section 24 generally radially extending from the root section 22. The root section 22 is mounted into a corresponding recess of a rotary support structure of the turbine disc (not shown). The shape of the hollow section 24 may depend on its location within the gas turbine engine 10, the operating parameters of the gas turbine engine 10, etc.

The root section 22 of the turbine blade includes one or more cooling air inlets receiving cooling air from a plenum located on the upstream side of the turbine disk. The cooling air inlet or inlets lead to the interior of the hollow section 24. In use, relatively cool air, bled typically from the compressor 14, is fed to the cooling air plenum through conventional means (not shown) and then enters through the root section 22. The air enters internal passages (described below) to thereby cool the airfoil 20.

Air exits through holes (not shown) provided for surface film cooling and through one or more preferably, a plurality of trailing edge exit holes 26 located adjacent to the trailing edge 28 of the airfoil 20.

Figure 3:
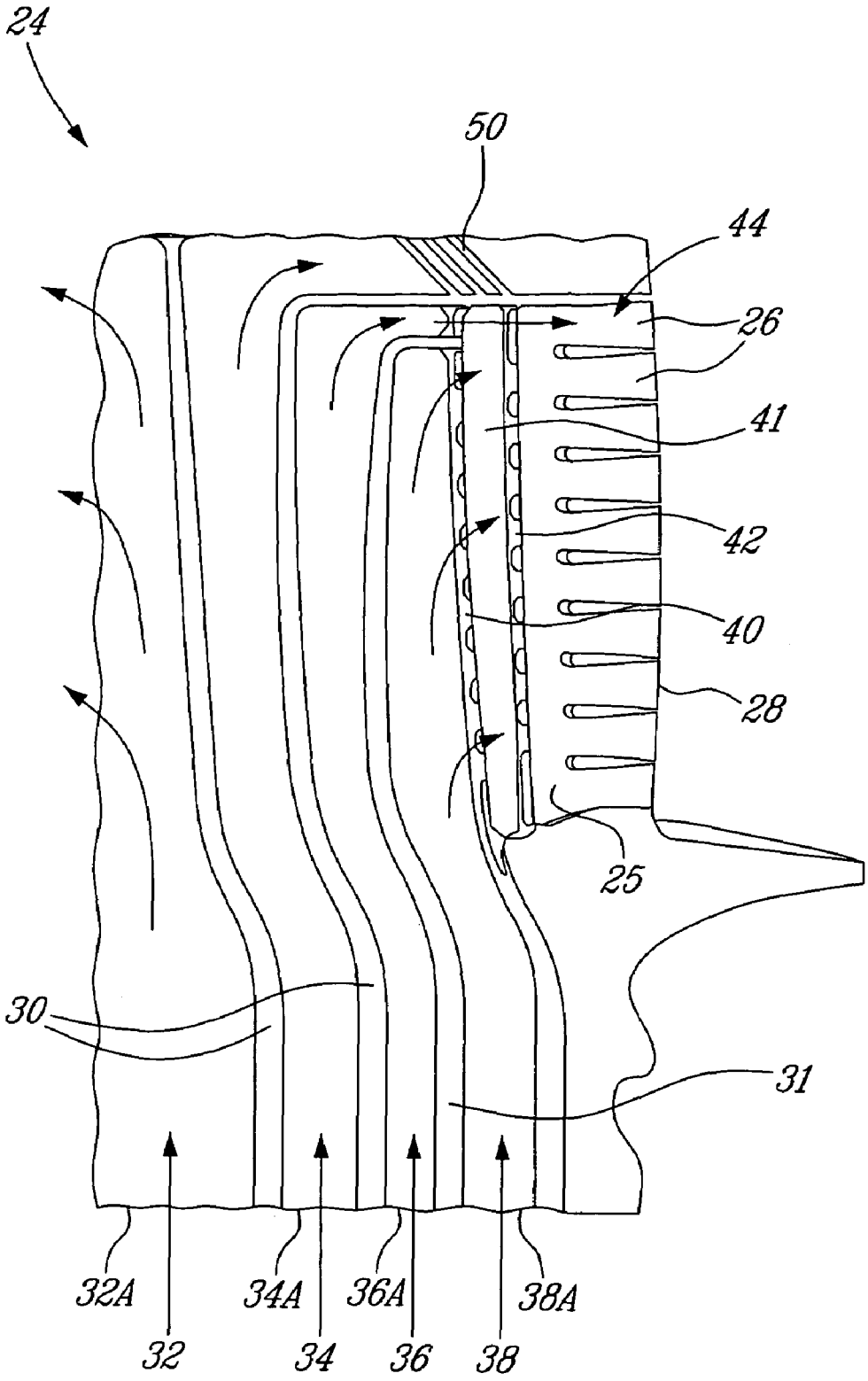
FIG. 3 is an enlarged side view of the internal passages shown in FIG. 2.

FIG. 3 illustrates an enlarged portion of FIG. 2. The hollow section 24 comprises a plurality of partition walls 30 configured and disposed to define internal air cooling passages 32, 34, 36 and 38 having respective inlets 32A, 34A, 36A and 38A.

Figure 4:
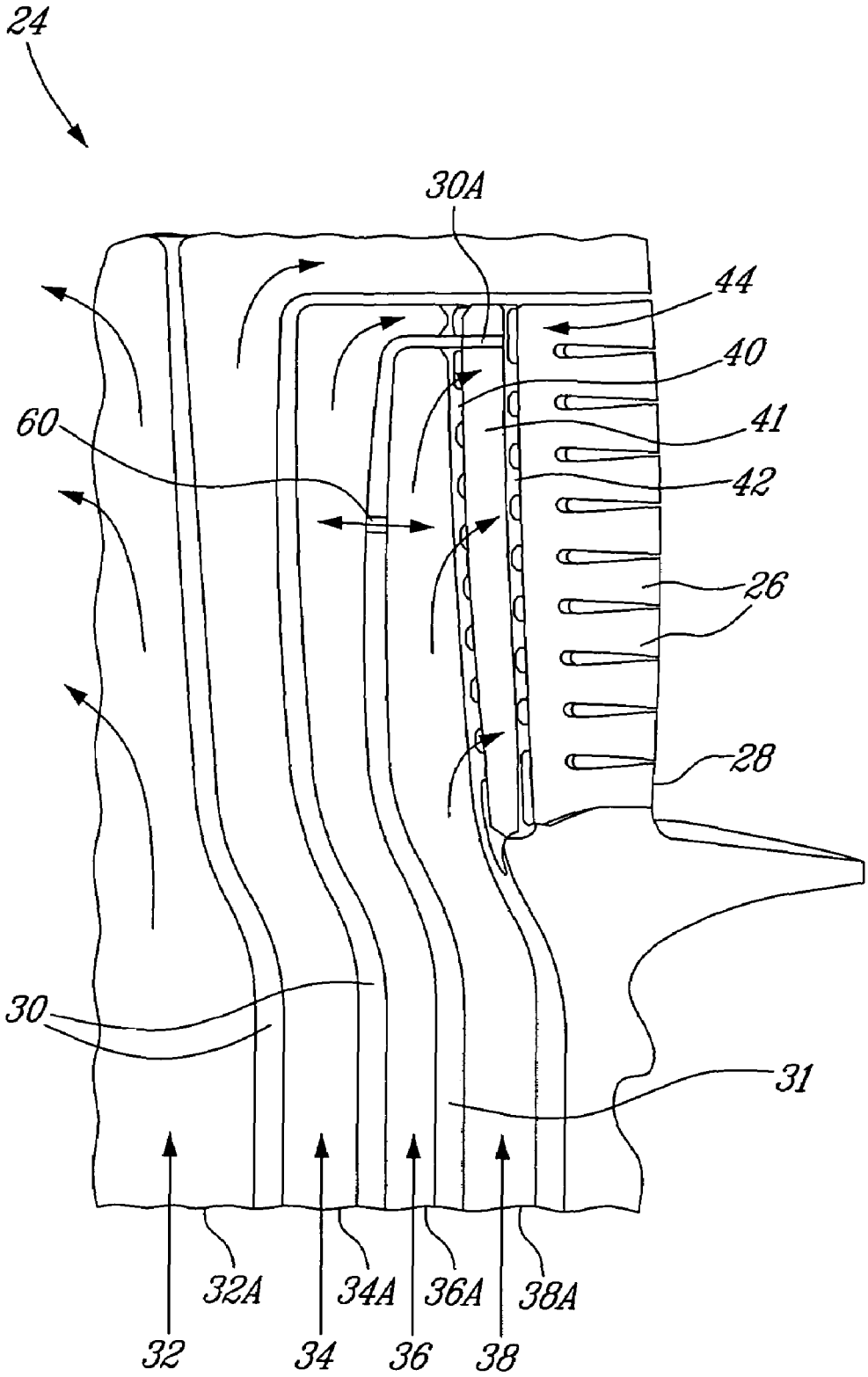
FIG. 4 is a view similar to FIG. 3, showing another embodiment.

Passages 36 and 38 are preferably independent from each other (i.e. in parallel) from inlet 36A/38A to intermediate plenum 41 and/or exit plenum 25, but if desired may be in partial fluid communication using aperture(s) or other openings 60, as shown in FIG. 4, depending on the design and operational requirements. FIG. 4 schematically illustrates that one (or more) aperture(s) 60 can optionally be provided in one or more of the partition walls 30.

In this application the term "crossover" is used to describe an internal wall which contains numerous openings permitting air to pass therethrough. The flow of cooling air is controlled by adjusting the size and number of these openings. At least one crossover is located at the rear of the hollow section 24. The illustrated airfoil 20 is shown with a first crossover 40 and a second crossover 42. The second crossover 42 is located between the first crossover 40 and the trailing edge 28, and an intermediate plenum 41 is located therebetween. They are generally extending radially inside the hollow section 24. An exit plenum 25 is interposed between second crossover 42 and exit holes 26.

The first crossover 40 comprises what is generally referred to as a distal end portion 44, which is located near the end of the first crossover 40 which is remote or distally opposite from inlets 36A, 38A of passages 36 and 38 (i.e. the upper end as depicted in FIG. 4). The airfoil 20 is designed so that the first crossover 40 is preferably in fluid communication with at least two substantially spatially parallel passages 36, 38, one of which preferably ends at the distal end portion 44. As mentioned, the passages are preferably in "parallel" both spatially and fluidly, and are divided by a partition wall 30. In particular, the passages 36 and 38 are divided by a bypass divider wall 31. The flow of cooling air coming out of the trailing edge exhaust ports 26 is thus divided by one of the partition walls 30, namely bypass divider wall 31, which creates the "bypass" passage 36 and the "rear" passage 38. The rear passage 38 can be further divided with additional partition walls 30 (not shown) to provide additional parallel passages. The bypass passage 36 is selected so as to minimize air stagnation therein, as described further below. In FIG. 3, the bypass passage 36 communicates with the distal end portion 44 of the first crossover 40. FIG. 4 illustrates that the partition wall 30 may include an extension 30A between the bypass passage 36 and the rear passage 38 to second crossover 42, so that air passing through the bypass passage 36 is directed to exit plenum 25 without flowing into the intermediary plenum 41.

Figure 5:
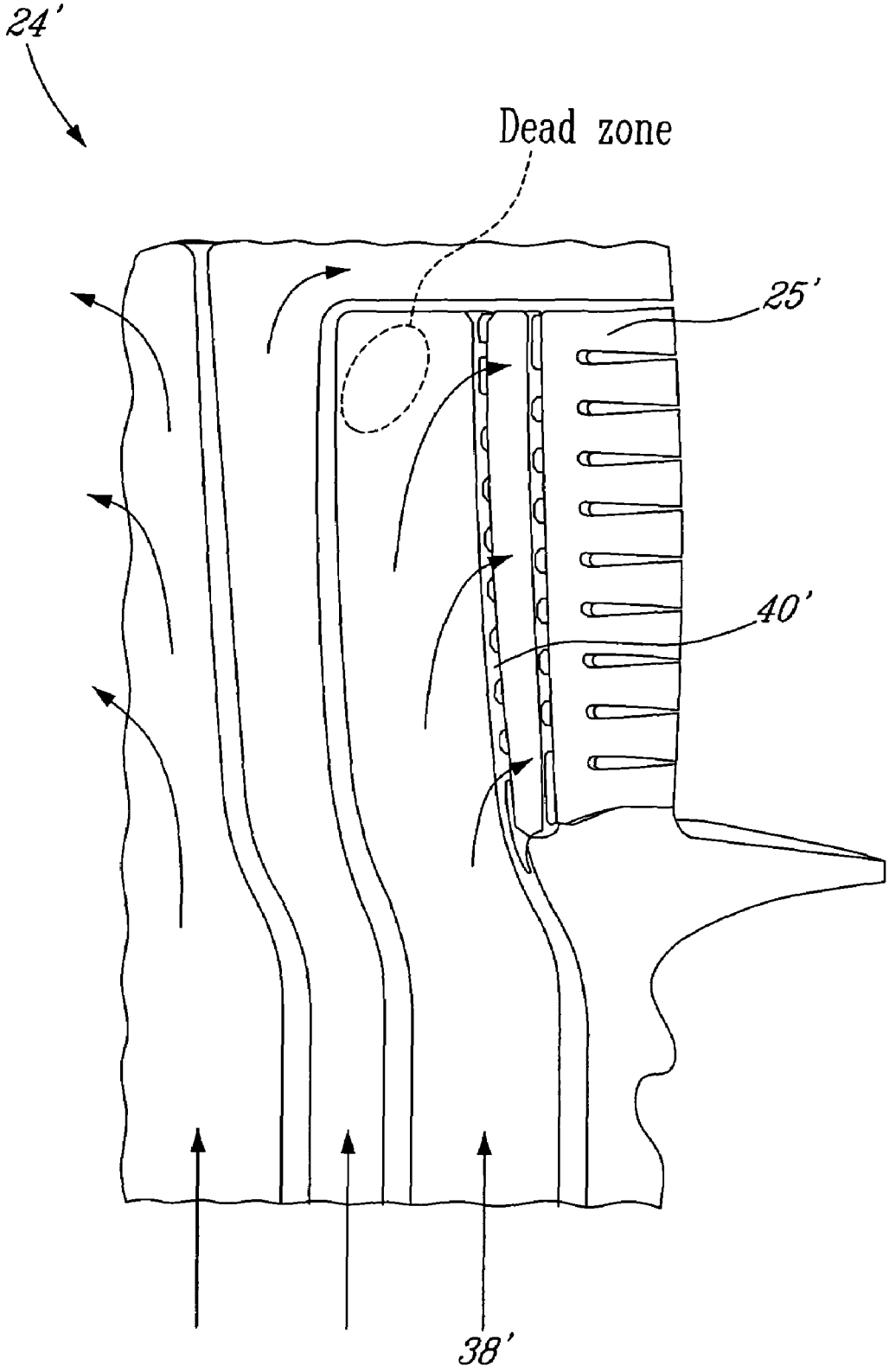
FIG. 5 is a side view of a cooling passage which does not include the present invention.

To assist an illustration of the operation of the present invention, FIG. 5 shows a portion of a hollow section 24' similar to FIGS. 3 and 4, but without the bypass passage 36 and bypass divider wall 31 shown in FIGS. 3 and 4. Due to the relatively wide chord of the airfoil, the passage 38' feeding crossover 40' and exit plenum 25' are relatively wide. Passage 38' is thus prone to the unintentional but unavoidable creation of an air "dead zone" of more or less stagnant air which undesirably decreases convective heat transfer to the cooling flow. By contrast, in FIGS. 3 and 4, the two narrower passages 36, 38 are substituted for the single passage 38' of FIG. 5, and the bypass divider wall 31 between them is configured to direct air in passages 36 and 38 in a manner to substantially reduce the presence of an air "dead zone" therein. Benefit is thus is achieved without requiring a larger number of turns or a longer overall passage, and thus minimizes introduced aerodynamic losses. The presence of the bypass divider wall 31 between the bypass passage 36 and the rear passage 38 also strengthens the airfoil 20, which is also particularly beneficial in a wide chord blade.

A new method of cooling an airfoil of a gas turbine engine comprises dividing the flow of cooling air directed to the exit plenum 25 in at least two parallel cooling air paths prior to directing the cooling air to the exit plenum 25, preferably via a crossover 40. One of the cooling air paths 36 is preferably directed to a distal end portion of the plenum 25, while the other passage 38 is directed through the trailing edge inwardly therefrom relative to the inlets. This parallel geometry helps distribute the air to reduce stagnation and internal pressure losses.

The above description is meant to be exemplary only, and one skilled in the art will recognize that changes may be made to the embodiments described without departing from the scope of the invention disclosed. For example, although application of the invention to a turbine blade is described and depicted herein, the invention may be applied to compressor and turbine blades and vanes. The invention can be used concurrently with other cooling techniques for increasing the heat transfer between the internal structures of the airfoil 20 and the cooling air. The various means for promoting internal heat transfer between the internal structures and the cooling air include dimples, trip strips, pedestals, fins, etc., all of which are intended to be indicated and schematically represented in FIG. 3 as reference numeral 50. Other techniques to introduce turbulence into the cooling air flow to promoting convective heat transfer may also be used, or none at all may be used. The crossovers may be omitted, if desired. Still other modifications will be apparent to those skilled in the art in light of a review of this disclosure and such modifications are intended to fall within the scope of the appended claims.

What is claimed is:

1. An internally cooled airfoil for a gas turbine engine, the airfoil having a hollow section and a trailing edge, the airfoil comprising:

a plurality of partition walls located in the hollow section and defining at least two internal cooling air passages substantially parallel to one another and each extending from a respective inlet to at least one respective outlet defined in the trailing edge, the at least two internal cooling air passages configured to direct all of the air entering their respective inlets to their respective at least one outlet defined in the trailing edge; and at least one crossover located in the hollow section adjacent to the at least one outlet in the trailing edge, the crossover spaced apart from the trailing edge to define a plenum between the crossover and the at least one outlet in the trailing edge, the crossover generally extending radially in the hollow section and having a distal end portion on an end of the airfoil distally opposite the inlets of the passages, the crossover and the plenum being in fluid communication with the at least two passages one of which said at least two passages being dedicated to supplying cooling air to the distal end portion of the crossover.

2. The cooled airfoil as defined in claim 1, wherein the at least two substantially parallel passages are fluidly independent of one another.

3. The cooled airfoil as defined in claim 2, wherein the airfoil comprises a turbine blade, the at least two substantially parallel passages being independent beginning at a root section of the turbine blade.

4. The cooled airfoil as defined in claim 1, wherein the at least two substantially parallel passages are partially in fluid communication with one another through at least one aperture in an intermediate partition wall.

5. An internally cooled gas turbine airfoil comprising:

a hollow airfoil body having a first end, a second end and a trailing edge extending therebetween;

at least one crossover located in the hollow airfoil body and adjacent to the trailing edge thereof and a plurality internal passages defined in the hollow airfoil body, the passages including at least two passages extending from distinct inlets in the first end and in parallel communication with an exit plenum defined in the hollow airfoil body between the at least one crossover and the trailing edge, wherein the passages are disposed side-by-side and direct all the air entering their respective inlets to the at least one crossover, and wherein a first one of said at least two passages communicates directly with a substantially larger portion of the exit plenum than a second, the second passage of the at least two passages communicating with the exit plenum at a location closer to the second end than the first passage of the at least two passages; and the inlet of the first passage of the at least two passages being located closer to the trailing edge than the inlet of the second passage of the at least two passages.

6. The cooled airfoil as defined in claim 5, wherein the at least two passages are in fluid communication through at least one aperture in an intermediate partition wall dividing the passages.

7. The cooled airfoil as defined in claim 5, wherein the passages are divided by an intermediate partition wall and wherein a major portion of the wall extends substantially parallel to the trailing edge.

8. The cooled airfoil as defined in claim 5, wherein the airfoil has two crossovers, the second crossover positioned between the passages and the first crossover, the crossovers defining an intermediary plenum between them.

9. The cooled airfoil as defined in claim 8, wherein one of the at least two passages supplies cooling air through a radially-outward end portion of the second crossover and ends at a radially-outward end portion of the first crossover.

10. An airfoil for use in a gas turbine engine, the airfoil comprising a hollow section with passages adapted to direct an internally-circulating flow of cooling air, the airfoil including a trailing edge, at least one crossover adjacent to the trailing edge and an exit plenum between the at least one crossover and the trailing edge, the hollow section including partition walls separating adjacent passages, the adjacent passages including at least two fluidly parallel cooling air paths upstream of and communicating in parallel with the exit plenum, all the air entering the at least two cooling air paths being directed to the exit plenum.

11. The airfoil as defined in claim 10, wherein the at least two parallel cooling air paths are independent.

12. The airfoil as defined in claim 11, wherein the airfoil is part of a turbine blade, the at least two parallel cooling air paths being independent beginning from a root section of the turbine blade.

13. The airfoil as defined in claim 10, wherein the at least two parallel cooling air paths are partially in fluid communication through at least one aperture in one of the intermediate partition walls.

14. A method of cooling an airfoil of a gas turbine engine using an internally-circulating flow of cooling air, the airfoil including a trailing edge, at least one crossover adjacent to the trailing edge and an exit plenum between the at least one crossover and the trailing edge, the method comprising:

dividing the flow of cooling air in at least two parallel cooling air paths; and then directing all of the air from the cooling air paths through the exit plenum, one of the cooling air paths being dedicated to supply air to a radially-outward end portion of the exit plenum.

15. The method as defined in claim 14, wherein the at least two cooling air paths are substantially parallel beginning from inlets thereof.

16. The method as defined in claim 14, further comprising mixing cooling air between the at least two cooling air paths upstream of the exit plenum.

17. The method as defined in claim 16, wherein cooling air is mixed from a first of the at least two cooling air paths to a second of the at least two cooling air paths using at least one aperture in an intermediate partition wall.

* * * * *